US006241480B1

(12) United States Patent
Chu et al.

(10) Patent No.: US 6,241,480 B1
(45) Date of Patent: Jun. 5, 2001

(54) MICRO-MAGNETOHYDRODYNAMIC PUMP AND METHOD FOR OPERATION OF THE SAME

(75) Inventors: Charles Ye Yingjie Chu, Rolling Hills Estates; Guann Pyng Li, Irvine, both of CA (US)

(73) Assignee: The Regents of the Unversity of California, Oakland, CA (US)

( * ) Notice: Subject to any disclaimer, the term of this patent is extended or adjusted under 35 U.S.C. 154(b) by 0 days.

(21) Appl. No.: 09/472,646

(22) Filed: Dec. 27, 1999

Related U.S. Application Data

(60) Provisional application No. 60/114,203, filed on Dec. 29, 1998.

(51) Int. Cl.[7] ..... F04F 11/00; F04B 17/00; F04B 39/10; F04B 7/00

(52) U.S. Cl. ..... 417/99; 417/410.1; 417/571; 417/505

(58) Field of Search ..... 417/92, 99, 410.1, 417/571, 505, 54

(56) References Cited

U.S. PATENT DOCUMENTS

| | | | | |
|---|---|---|---|---|
| 1,792,449 | * | 2/1931 | Spencer | 310/11 |
| 1,881,724 | * | 10/1932 | Lehrer | 417/417 |
| 2,258,415 | * | 10/1941 | Lago | 417/99 |
| 3,963,380 | * | 6/1976 | Thomas, Jr. et al. | 417/322 |
| 4,928,125 | * | 5/1990 | Iino | 346/140 R |
| 4,990,059 | * | 2/1991 | James | 417/50 |
| 5,256,036 | * | 10/1993 | Cole | 417/48 |
| 5,632,876 | * | 5/1997 | Zanzucchi et al. | 204/600 |

* cited by examiner

*Primary Examiner*—Charles G. Freay
*Assistant Examiner*—Timothy P. Solak
(74) *Attorney, Agent, or Firm*—Daniel L. Dawes, Esq.; Myers, Dawes & Andras LLP

(57) ABSTRACT

A micropump fabricated in a planar substrate is provided with a valving chamber which is communicated to a pumping chamber. The valving chamber has an inlet and outlet port. Both the valving chamber and pumping chamber have a liquid, electrically conductive piston disposed therein, which liquid piston is nonmiscible with the pumped working fluid and nonreactive with the substrate in which the chambers are formed. The valving piston is magnetohydrodynamically driven to selectively close either the inlet port or the outlet port. The pumping piston is magnetohydrodynamically driven to pull or push the working fluid through one of the inlet or outlet ports, through the valving chamber, into the pumping chamber, back out of the pumping chamber and through the other one of the inlet or outlet ports after activation of the valving piston. Both direct current and inductive magnetohydrodynamic drives are contemplated. The valving and/or pumping chambers may be shaped or narrowed in their dimensions to impose a mechanical bias on the respective valving and/or pumping pistons to assume a preferred position in their respective chambers when the magnetohydrodynamic drive is turned off.

27 Claims, 2 Drawing Sheets

MICRO-MAGNETOHYDRODYNAMIC PUMP AND METHOD FOR OPERATION OF THE SAME

RELATED APPLICATION

The present application relates to U.S. Provisional Patent Application, serial no. 60/114,203, filed on Dec. 29, 1998, which is incorporated herein by reference.

BACKGROUND OF THE INVENTION

1. Field of the Invention

The present invention relates to a micropump for delivering fluid at a low and controllable flow rate.

2. Description of the Prior Art

Science and engineering have been devoted to building machines that mimic human's functionality to expand our reach. The Industrial Age came about due to the invention of steam engine which freed human from laborious muscle works. With the advent of electronics, computers are revolutionizing the Information Age. Advances in microelectronics processing have opened up a far reaching capabilities in microengineering.

In recent years, there has been an explosion of interest in the field of integrated MicroElectroMechanical Systems (MEMS). The field is still so new that there is no commonly accepted definition of the field among researchers. Instead of fashioning devices that simply shunt electrons, moving devices are fabricated. While integrated circuit technology is essentially a two-dimensional or planar process. MEMS works in a three dimensional process. Because much of the key process is not radically different from fabricating microelectronics elements, many essential techniques can be simply copied.

Rooted back in the early research effort on materials and processing for the fast emerging field of integrated circuits, the late 1960's and early 1970's saw the effort in developing integrated sensors. After early attempts to make temperature and pressure sensors, visible image arrays were produced in large volume. After years of steady improvement, today visible image arrays rival the resolution of photographic films and promise to revolutionize the field of photography. Though they represent some of the largest chips made. Only a few processes and packaging techniques go beyond standard integrated circuit manufacturing.

1970's saw considerable advances in bulk micromachining. The emergence of preferential etch, and impurity based etch-stops took silicon based sensors out of laboratories into mass production. Pressure sensors led the way. Much attention was concentrated on preferential etch and sealing technique to make pressure sensors a reality on silicon. Late 1980's surface micromachining led to the development of a series of AC resonant sensors. Gradually, accelerometer and flowmeters joined pressure sensors as high-volume production devices.

Today, bulk and surface micromachining, in combination with wafer-to-wafer bonding and electroforming technologies offer a designer a rich array of processes for the creation of micromechanical structures in batch and with high precision. It has been established that micromachined sensors can be produced with high yield. They can be merged with integrated electronics, both in monolithic and multi-chip hybrid assemblies. These devices are widely used in high performance instrumentation and control system. To date, VLSI interface circuitry with digital signal processing has pushed some sensors to reach 16-bit accuracy and feature self-testing and digital compensation possible for commercial mass production.

Since micromachined sensors are passive devices, a complete mechanical system is not readily implemented. In order to complete the system, actuators, namely machines that cause other devices to move, are badly needed. In 1988, combining surface micromachining, the emergence of electrostatic actuators were widely researched. Later, other actuation methods such as thermal and resonant actuation also demonstrated their possibilities.

With the addition of microactuators to microsensors and microelectronics interface circuitry, most of all the elements for a complete MEMS were in place. However, due to the complexity of microactuators, integration has proven to be difficult. Microactuators which were being produced were never fully satisfactory for practical applications. To date, electrostatic microactuators remain as the accepted means of actuation in microscale. Only recently has the possibility of magnetostatic microactuators been realized with reasonable success.

The requirements for an ideal microactuator can be overwhelming. A microactuator has to be able to transfer its driving energy to other devices. A low loss energy transmission must be incorporated into the system. The driving voltage for the microactuator must be compatible with integrated circuits, which can mean well below 15 volts, in order to be controlled by on chip electronics. Reliability of the microactuator should be as unquestionable as the driving electronics themselves. And last, the fabrication process should be compatible with electronics fabrication processes.

What is needed to address these requirements is a completely different approach to achieve microactuation.

BRIEF SUMMARY OF THE INVENTION

In order to address shortcomings relating to other microactuators, the present invention provides microactuation in microscale based on magnetohydrodynamics. What is disclosed is a micromechanical device capable of microactuating a conductive fluid inside capillary channel or chamber.

In a preferred embodiment, the microactuator is comprised of a source to produce a constant external magnetic field, a channel or chamber where an electrically conductive fluid flows, and electrodes that make electrical contact with the fluid. The direction of magnetic field, the direction of channel flow, and the direction of the electric current are mutually perpendicular to each other. When electric current is applied to the electrodes, the resulting Lorentz force pumps the conductive fluid towards one end of the chamber. The pumped fluid can be used directly as hydraulic fluid to act on another part of a system, or it can be used to pump other fluids.

The pump has no moving parts which are used for pumping the fluid other than two liquid masses or pistons. It has a low operating voltage or current operating mode, and also has a simple and effective energy transfer means to other components. In addition, the microactuator allows the use of a planar process for device fabrication with no specific requirement on different types of substrate materials.

More specifically the invention is defined as an apparatus for pumping a working fluid comprising a pumping chamber and a valving chamber communicated to the pumping chamber and having an inlet port and an outlet port. These are microcapillary chambers and may be interchangeably described as channels. A liquid, electrically conductive pumping piston is disposed in the pumping chamber. Similarly, a liquid, electrically conductive valving piston disposed in the valving chamber. The pistons are actually a movable mass of material, such as a low melting temperature metal, such as mercury or gallium alloys. An exterior source of heat may be provided to control the liquid-solid state of the pistons at any given point in time. Two magnetohydrodynamic drives are provided. One for the pumping piston and one for the valving piston. A valve magnetohydrodynamic drive is disposed in proximity to the valving piston to controllably move the valving piston within the valving chamber to control direction of flow of the working fluid into and out of the inlet and outlet ports in the valving chamber. The pump magnetohydrodynamic drive is disposed in proximity to the pumping piston to controllably move the pumping piston within the pumping chamber so that the working fluid is pumped into and out of the pumping chamber.

The pump and valve magnetohydrodynamic drive may each be a direct current magnetohydrodynamic drive, each be an induction magnetohydrodynamic drive, or one may be a direct current magnetohydrodynamic drive and the other an induction magnetohydrodynamic drive.

In the preferred embodiment the liquid, electrically conductive valving piston and the liquid, electrically conductive pumping piston are comprised of a liquid metal, although this is not necessary. Any liquid conductive material with the appropriate surface tension characteristics to provide a seal in the chambers and remain intact as a single mass may be employed.

The pumping chamber and the valving chamber are preferably fabricated in at least one planar substrate, usually the same common substrate although separate substrates could be employed in separate fabrication processes and then joined to communicate the two chambers on later assembly.

In an alternative embodiment at least a portion of the pumping chamber has a narrowed dimension as compared to another portion of the pumping chamber so that the liquid, electrically conductive pumping piston is biased to move away from the portion with a narrowed dimension toward the other portion of the pumping chamber. The dimension which is narrowed may or may not correspond topologically with each other in the two portions of the chamber. For example, width of the chamber may be narrowed at one end and the width in an orthogonal direction widened in the opposing end. Any shaping of the chamber which would create a bias to position the piston is contemplated as included in the invention.

In one embodiment the valving chamber and pumping chamber are communicated with each other through at least two interior ports. The interior ports are alternatively closed by movement of the valving piston. The valving chamber has a centerline and the interior ports are disposed closer to the centerline than are the inlet and outlet ports.

Alternatively, the valving chamber and pumping chamber are communicated with each other by a single interior port or a multiplicity of ports which are in one location. The single interior port or ports at one location is open or uncovered by the valving piston, when the valving piston covers either the inlet port or the outlet port. The valving piston is displaced to completely cover either the inlet port or the outlet port, but not both.

The invention is also defined as a method for pumping a working fluid in an apparatus as described above. More specifically, the method comprises the steps of controllably, magnetohyrdodynamically moving a liquid, electrically conductive valving piston disposed in a valving chamber to controllably open or close an inlet port or an outlet port. Similarly, a liquid, electrically conductive pumping piston disposed in a pumping chamber is controllably, magnetohyrdodynamically moved to pump the working fluid through an opened one of the inlet or outlet ports.

The invention now having been briefly summarized, an illustrated embodiment of the invention can be better visualized in the following drawings turn to the following drawings wherein like elements are referenced by like numbers. It must be expressly understood, that the invention is not limited by the particular features which are used in the illustrations, but encompasses the full range of equivalents and logical embodiments which are included within the scope and meaning of the following claims.

Figure 1:
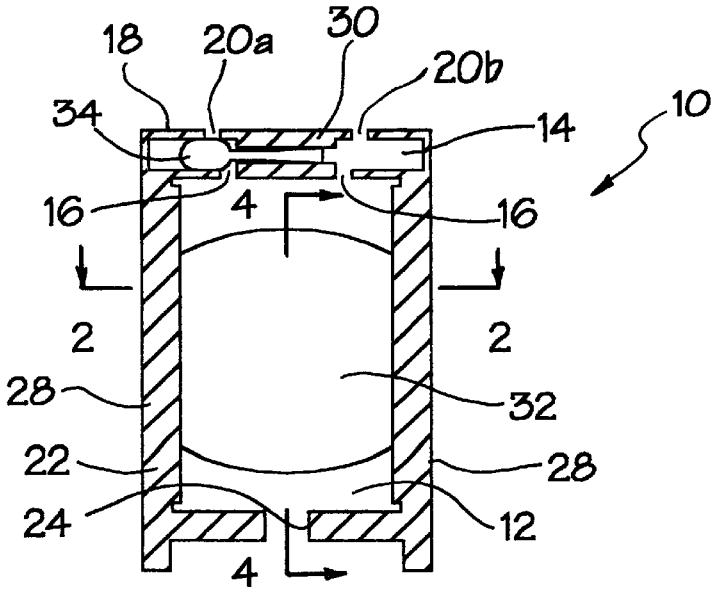
FIG. 1 is a diagrammatic side cross-sectional view of the present invention, showing the micropump comprised of a main pump chamber and a valve chamber.

The invention and its various embodiments can be understood as set forth in the following detailed description.

DETAILED DESCRIPTION OF THE PREFERRED EMBODIMENTS

A micropump 10 is comprised of two micro-capillary tubes coupled to the inlet and outlet ports 20*a* and 20*b* and the pump 10, and two pistons 32 and 34 driven by magnetohydrodynamic (MHD) mechanisms. Piston 34 operates the opening and closing of the valve ports 20*a* and 20*b*, while the other piston 32 changes the volume of the pump chamber 12.

Before reviewing a detailed description of the invention, consider first some of its advantageous features. A first feature of the present invention is the fabrication of the micropump 10 using a planar manufacturing process, which allows miniaturization and mass manufacture of the device using conventional silicon micromachining techniques and integration with other micromachined and circuit components on the same substrate. For example, pump 10 may be fabricated so that the embodiment of FIG. 1 is entirely circumscribed in a volume of 1×1×5 mm. As a result of using a liquid metal or a conducting liquid, the micropump 10 has a reliable means for pumping that is sufficiently small in size. In the illustrated embodiment, the mechanism which converts electrical energy to mechanical energy is implemented by a combination using liquid metal pistons 32 and 34. The liquid metal pistons 32 and 34 not only facilitate the action of pumping, but also ensures the opening and closing of the flow passages to and from the main pumping chamber 12. Pistons 32 and 34 also provide adequate sealing to prevent leakage of the working fluid past them. By reversing the sequence of opening and closing of the flow passages to and from main pump chamber 12, the liquid metal pump 10 can easily perform bidirectional pumping.

The second feature of the present invention is that the electrical specifications on the power supply voltage needed to drive pump 10 are relaxed as contrasted to other types of MEMS actuators demanding a special high voltage power supply. This will simplify electronic circuit design for feedback control as well as reduce the potential risk of subjecting the fluid to the high voltage environment. For example, a power supply having a voltage of the order of magnitude of 5 volts and current capacity of the order of magnitude of 1 amp will easily drive pump 10.

In the present invention, the micropump, generally denoted by reference numeral 10, is comprised of a rectangular main pump chamber 12 and a rectangular valve chamber 14 as shown in the diagrammatic side cross-sectional view of FIG. 1. The valve chamber 14 is connected to the main pump chamber 12 through multiple openings 16, which can be a single opening, or two or more openings. In this illustration, two openings 16 have been used. Two additional openings 20*a* and 20*b* defined in the wall 18 of the valve chamber 14 form the inlet 20*a* and outlet 20*b* to and from the main pump chamber 12. Defined in the chamber wall 22 of main pump chamber 12 the opposite from the valve chamber 14, is an opening 24 to release pressure when the piston 32 in main chamber 12 moves. All of the openings 16, 20*a*, 20*b* and 24 are much smaller than the axial diameters of either chambers 12 or 14. For example, when the liquid metal is mercury, then the range of sizes of openings 16, 20*a*, 20*b* and 24 includes 100 microns. The shape of the cross section of openings 16, 20*a*, 20*b* and 24 is arbitrary.

Chamber walls 22 itself can be fabricated from any electrically insulating material provided that the substrate material in which pump 10 is fabricated has no surface reaction to the fluids in chambers 12 or 14. Any electrically conductive fluids, such as liquid metals, alkalis, or electrolytes, can be serve as the magnetohydrodynamic fluid. A certain degree of conductivity may be necessary when the external magnetic field is weak and internal flow friction is high. However, when electrolytes are used, care must be taken so that electrolysis does not occur at the main chamber electrode pair 28 or valve chamber electrode pair 30. Main chamber electrode pair 28 or valve chamber electrode pair 30 comprise each a pair of opposing electrodes mounted in main or valve chambers 12 and 14 respectively. Main chamber electrode pair 28 or valve chamber electrode pair 30 are disposed on opposing walls of their respective chambers 12 and 14 and are electrically coupled only when their respective pistons 32 or 34 move between them. As will be described in connection with FIGS. 2 and 3, the current flow through pistons 32 and 34 provided by electrode pairs 28 and 30 in combination with an external applied magnetic field result in a mechanical force which moves pistons 32 and 34 and will hence pump the working fluid. Electrodes 28 and 30 are assumed in the illustrated embodiment to be simple planar, sheet electrodes, but any pattern, form or design for an electrode can be substituted, such as circular, elliptical, interdigitated, banded or the like.

Liquid metals show the best promise for use as pistons 32 and 34, since it has the lowest resistivity. An incompressible hydraulic fluid can be used as the working fluid in pump 10 to deliver mechanical energy to other devices. However, this does not limit the possibility of using a compressible fluid, such as air, to further enhance the efficiency of the energy delivery.

In the example of the liquid metal pump shown in FIG. 1, both chambers are partially filled with a low melting temperature metal alloy, such as mercury or gallium alloys. It is to be expressly understood that the invention may use any conducting fluid consistent with the teachings of the invention as the material for pistons 32 and 34. The pump and valve pistons 32 and 34 respectively are made out of droplets or pools of the low melting point metal alloy. Exceptionally high surface tension exists in liquid metal to prevent the liquid metal from passing through the small openings, such as openings 16, 24, 20*a* and 20*b*, which thus act as a flow stop for the liquid metal, yet other fluids with lower surface tension pass unimpeded. At the same time, high surface tension inside the liquid metal causes pistons 32 and 34 to press tightly against the walls 22 of the chambers 12 and 14 preventing the pumped fluid from leaking pass pistons 32 and 34.

The properties of solid-liquid phase transition in liquid metal can be further taken advantage of for sealing chambers 12 and 14 against any liquid passage. Microheating elements can be fabricated in the proximity of chambers 12 and 14 to raise the temperature of the metal above its melting point to allow the liquid metal to move freely in chambers 12 and 14. However, as the temperature drops below the liquid metal's melting point, the metal enters solid phase and pistons 32 and 34 cease to move freely. This can provide full dead-stop valving action.

Consider now the operation of pump 10. As piston 32 is pulled away from the valve openings 16, there is a volumetric increase in the main pump chamber 12. If valve piston 34 is moved to the right in the illustration of FIG. 1, Fluid will flow from the inlet 20*a* and opening 16 through valve chamber 14 into main chamber 12. As the piston 32 is pushed towards openings 16, and if valve piston 34 is moved to the left in the illustration of FIG. 1, the fluid inside the pump chamber 12 is expelled through opening 16 into valve chamber 14 and out of outlet valve 20*b*.

Since the inlet valve 20*a* and outlet valve 20*b* are symmetric and identical, the inlet 20*a* can be treated as outlet 20*b* and vice versa depending only on the action of pistons 32 and 34.

It is desirable to have inlet 20*a* and outlet 20*b* to the valve chamber 14 offset further away from the center line of the main pump chamber 12 as shown in FIG. 1. This allows the valve piston 34 to fully close opening 16 leading to the main pump chamber 12 while still allowing fluid trapped at the end of the valve chamber 14 to leak out of valve chamber 14. In the simplest case, only one opening 16 leading to the pump chamber 12 is needed.

Figure 2:
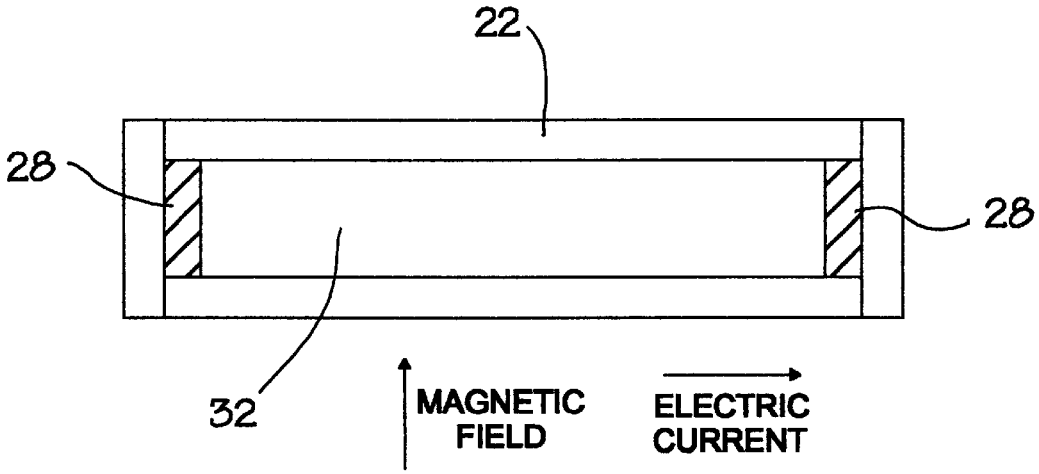
FIG. 2 is a side cross-sectional diagram as seen through lines 2—2 of FIG. 1 illustrating magnetohydrodynamic actuation by direct current case in which an external magnetic field that is oriented perpendicular to both the direction of flow and electrical current, which in the illustration of the figure is vertical on the page.

Actuation of pistons 32 and 34 is provided by means of magnetohydrodynamics. Magnetohydrodynamic actuation can be direct current or induction. In the direct current case as depicted in FIG. 2, an external magnetic field that is oriented perpendicular to both the direction of flow and electrical current, which in the illustration of the figure is vertical on the page. The magnetic field can be provided by either permanent magnet or by electromagnet. When direct current is passed through liquid metal of pistons 32 or 34 between electrode pairs 28 and 30 respectively, the resulting Lorentz force pushes the liquid metal itself. By reversing the direction of flow of the electrical current between electrode pairs 28 or 30, or reversing the direction of the external magnetic field, the direction of the Lorentz force on pistons 32 and 34 can also be reversed. The circuitry used to produce the direct current between the electrodes in proper synchronization with pistons 32 and 34 is entirely conventional and will not be further described.

Figure 3:
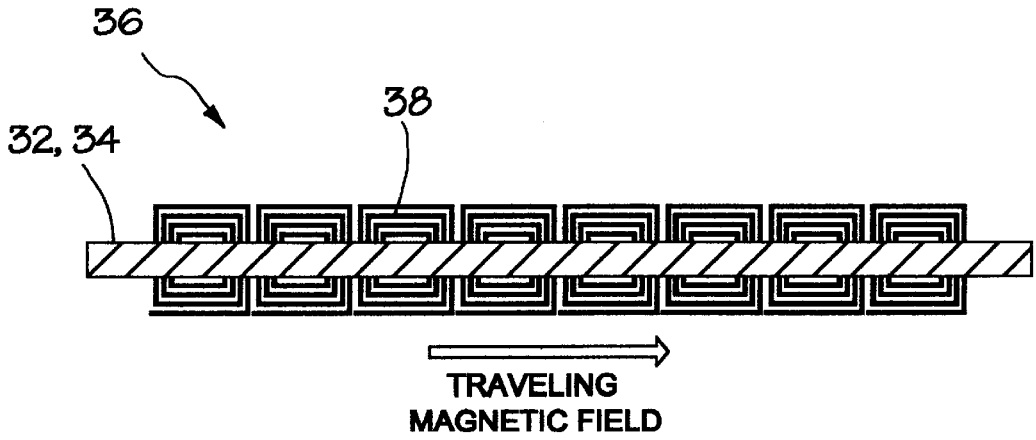
FIG. 3 is a highly diagrammatic depiction of an inductor array shown in plan elevational view which is used when the electrical current is induced by a traveling magnetic field.

In the case where magnetic induction is used to create eddy currents in pistons 32 and 34 as shown in FIG. 3, a linear array 36 of inductors 38 is located in the proximity to and parallel with the flow direction of the liquid metal or pistons 32 and 34. Array 36 is substituted for electrode pairs 28 and 30. One array may be provided in place of each electrode or for the electrode pair. Arrays 36 can be provided on the exterior of walls 22 of both valve chamber 14 and main chamber 12, or at least in a manner which electrically insulates inductors 38 from pistons 32 and 34 while leaving array 36 in close proximity to pistons 32 and 34. An electrical current is sequentially pulsed in one direction through every spiral inductor 38 in the inductor array 36. It must be understood that although inductor 38 is depicted diagrammatically as a spirally shaped inductor, that any shape or form for a magnetic inductor now known or later devised may be substituted. Thus, a spatially traveling magnetic field is thus produced along linear inductor array 36. The traveling magnetic field induces a current flowing inside the liquid metal of pistons 32 and 34, sometimes referred to an eddy current. As before an appropriately oriented external magnetic field is also provided. Consequently the induced force applied to pistons 32 and 34 moves pistons 32 and 34 in the chambers 12 and 14 to either ends depending on the direction of the pulsed current in array 36. The circuitry coupled to inductors 38 to provide the sequence of traveling magnetic field and hence the eddy currents in pistons 32 and 34 is conventional and shall not be further described.

Figure 4:
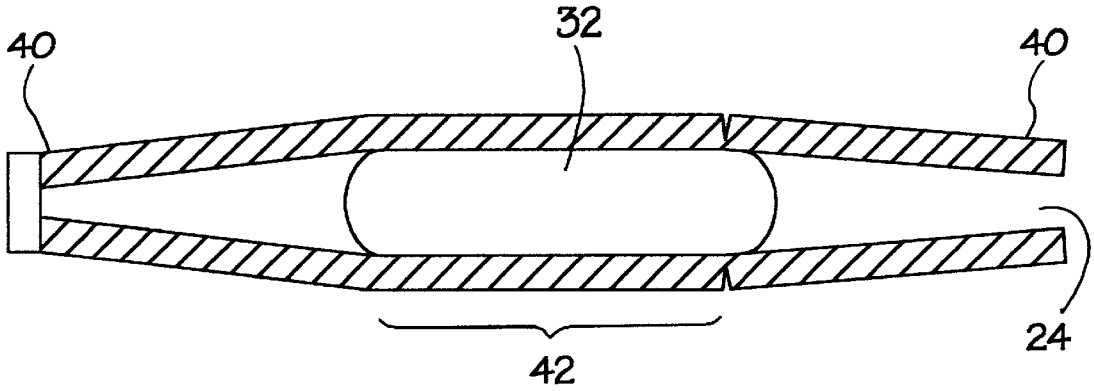
FIG. 4 is a vertical cross-sectional view of the main chamber of the pump as seen through section lines 4—4 of FIG. 1 shown in an alternative embodiment where the chamber is provided with at least one narrowing end to reposition the piston when electrical current is turned off.

To further enhance the micropump's functionality, the chambers or channels holding the liquid metal or pistons 32 and 34 can be tapered gradually at their ends 40 as diagrammatic depicted in FIG. 4. Again due to surface tension of the liquid metal comprising pistons 32 and 34, the liquid metal will tend to move to the part 42 of the channel with wider opening. In doing so, the position of piston 32 or 34, inside the channel will be determined when the electrical current is removed. This can be particularly important when it is necessary to have a normally off or on valve. In addition, it provides an easy resting place for the liquid metal to cool down and enter its solid phase.

Piston 32 and main chamber 12 can be used as disclosed above independently from piston 34 and valving chamber 14. For example, movement of the working fluid into and out of main chamber 12 may be the only action required in a particular application. In addition, piston 32 can be solidified at a controlled position within its movement range within main chamber 12 by means of temperature control of the substrate in which pump 10 is fabricated or located. The control of the position at which piston 32 can be solidified is then a substitute in some applications for the function of valving chamber 14 and piston 34.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention which could be more broadly or narrowly defined by patent claims.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims or that a single element may be substituted for two or more elements in the defined claims.

Insubstantial changes from the claimed subject matter as viewed by a person with ordinary skill in the art, now known or later devised, are expressly contemplated as being equivalently within the scope of the invention. Therefore, obvious substitutions now or later known to one with ordinary skill in the art are defined to be within the scope of the defined elements.

The invention is thus to be understood to include what is specifically illustrated and described above, what is conceptionally equivalent, what can be obviously substituted and also what essentially incorporates the essential idea of the invention.

We claim:

1. An apparatus for pumping a working fluid comprising:

a pumping chamber;

a liquid, electrically conductive pumping piston disposed in said pumping chamber; and a pump magnetohydrodynamic drive disposed in proximity to said pumping piston to controllably move said pumping piston within said pumping chamber so that said working fluid is pumped into and out of said pumping chamber;

a valving chamber communicated to said pumping chamber, and having an inlet port and an outlet port;

a liquid, electrically conductive valving piston disposed in said valving chamber; and a valve magnetohydrodynamic drive disposed in proximity to said valving piston to controllably move said valving piston within said valving chamber to control direction of flow of said working fluid into and out of said inlet and outlet ports in said valving chamber.

2. The apparatus of claim 1 wherein said valve and pump magnetohydrodynamic drive are each a direct current magnetohydrodynamic drive.

3. The apparatus of claim 1 wherein said valve and pump magnetohydrodynamic drive are each an induction magnetohydrodynamic drive.

4. The apparatus of claim 1 wherein said valve magnetohydrodynamic drive is a direct current magnetohydrodynamic drive and said pump magnetohydrodynamic drive is an induction magnetohydrodynamic drive.

5. The apparatus of claim 1 wherein said valve magnetohydrodynamic is an induction magnetohydrodynamic drive and said pump magnetohydrodynamic drive is a direct current magnetohydrodynamic drive.

6. The apparatus of claim 1 where said liquid, electrically conductive valving piston and said liquid, electrically conductive pumping piston are comprised of liquid metal.

7. The apparatus of claim 1 in further combination with at least one planar substrate and where said pumping chamber and said valving chamber are fabricated therein.

8. The apparatus of claim 1 in further combination with a single planar substrate and where said valving chamber and pumping chamber are both fabricated in said single planar substrate.

9. The apparatus of claim 2 where at least a portion of said pumping chamber has a narrowed dimension as compared to another portion of said pumping chamber so that said liquid, electrically conductive pumping piston is biased to move away from said portion with a narrowed dimension toward said other portion of said pumping chamber.

10. The apparatus of claim 1 where at least a portion of said pumping chamber has a narrowed dimension as compared to another portion of said pumping chamber so that said liquid, electrically conductive pumping piston is biased to move away from said portion with a narrowed dimension toward said other portion of said pumping chamber.

11. The apparatus of claim 1 where at least a portion of said valving chamber has a narrowed dimension as compared to another portion of said valving chamber so that said liquid, electrically conductive valving piston is biased to move away from said portion with a narrowed dimension toward said other portion of said valving chamber.

12. The apparatus of claim 11 where said valving chamber and pumping chamber are communicated with each other through at least two interior ports, said interior ports being alternatively closed by movement of said valving piston.

13. The apparatus of claim 11 where said valving chamber has a centerline and where said interior ports are disposed closer to said centerline than are said inlet and outlet ports.

14. The apparatus of claim 1 where said valving chamber and pumping chamber are communicated with each other by at least one interior port, said at least one interior port being open when said valving piston covers either said inlet port or said outlet port, said valving piston displaceable to completely cover either said inlet port or said outlet port, but not both.

15. A method for pumping a working fluid comprising:

controllably, magnetohyrdodynamically moving a liquid, electrically conductive valving piston disposed in a valving chamber to controllably open or close an inlet port or an outlet port; and controllably, magnetohyrdodynamically moving a liquid, electrically conductive pumping piston disposed in a pumping chamber to move said working fluid through an opened one of said inlet or outlet ports.

16. The method of claim 15 where controllably, magnetohyrdodynamically moving said liquid, electrically conductive valving piston and pumping piston are each moved using direct current magnetohydrodynamic drive.

17. The method of claim 15 where controllably, magnetohyrdodynamically moving said liquid, electrically conductive valving piston and pumping piston are each moved using induction magnetohydrodynamic drive.

18. The method of claim 15 wherein said valve magnetohydrodynamic drive is a direct current magnetohydrodynamic drive and said pump magnetohydrodynamic drive is an induction magnetohydrodynamic drive.

19. The method of claim 15 where controllably, magnetohyrdodynamically moving said liquid, electrically conductive valving piston is moved using induction magnetohydrodynamic drive, and where controllably, magnetohyrdodynamically moving said liquid, electrically conductive pumping piston is moved using direct current magnetohydrodynamic drive.

20. The method of claim 15 where controllably, magnetohyrdodynamically moving said liquid, electrically conductive pumping piston is moved using induction magnetohydrodynamic drive, and where controllably, magnetohyrdodynamically moving said liquid, electrically conductive valving piston is moved using direct current magnetohydrodynamic drive.

21. The method of claim 15 further comprising providing liquid metal for said liquid, electrically conductive valving piston and said liquid, electrically conductive pumping piston.

22. The method of claim 15 further comprising fabricating valving chamber and pumping chamber in at least one planar substrate.

23. The method of claim 15 further comprising fabricating said valving chamber and pumping chamber in a common planar substrate.

24. The method of claim 15 where at least a portion of said pumping chamber has a narrowed dimension as compared to another portion of said pumping chamber and further comprising biasing said liquid, electrically conductive pumping piston away from said portion with a narrowed dimension toward said other portion of said pumping chamber.

25. The method of claim 15 where at least a portion of said valving chamber has a narrowed dimension as compared to another portion of said valving chamber and further comprising biasing said liquid, electrically conductive valving piston away from said portion with a narrowed dimension toward said other portion of said valving chamber.

26. The method of claim 15 further comprising communicating said valving chamber and pumping chamber with each other through at least two interior ports, and alternatively closing said interior ports by movement of said valving piston.

27. The method of claim 15 further comprising communicating said valving chamber and pumping chamber with each other by at least one interior port, opening said at least one interior port when said valving piston covers either said inlet port or said outlet port, and displacing said valving piston to completely cover either said inlet port or said outlet port, but not both.

* * * * *